US006087085A

United States Patent [19]

Elst

[11] Patent Number: 6,087,085

[45] Date of Patent: Jul. 11, 2000

[54] PREPARATION METHOD OF MORPHOLOGICALLY HOMOGENEOUS (111) TABULAR CRYSTALS RICH IN SILVER BROMIDE

[75] Inventor: Kathy Elst, Kessel, Belgium

[73] Assignee: Agfa-Gevaert, N.V., Mortsel, Belgium

[21] Appl. No.: 09/168,986

[22] Filed: Oct. 9, 1998

Related U.S. Application Data

[60] Provisional application No. 60/070,498, Jan. 5, 1998.

[30] Foreign Application Priority Data

Oct. 24, 1997 [EP] European Pat. Off. ..... 97203313

[51] Int. Cl.[7] ..... G03C 1/015; G03C 1/035; G03C 1/047; G03C 1/005

[52] U.S. Cl. ..... 430/567; 430/569; 430/642

[58] Field of Search ..... 430/567, 569, 430/642

[56] References Cited

U.S. PATENT DOCUMENTS

| | | | |
|---|---|---|---|
| 5,567,580 | 10/1996 | Fenton et al. | 430/567 |
| 5,723,278 | 3/1998 | Jagannathan et al. | 430/567 |

FOREIGN PATENT DOCUMENTS

| | | | |
|---|---|---|---|
| 0 697 618 A1 | 2/1996 | European Pat. Off. | G03C 1/047 |
| 0 843 208 A1 | 5/1998 | European Pat. Off. | G03C 1/005 |

*Primary Examiner*—Mark F. Huff
*Attorney, Agent, or Firm*—Breiner & Breiner

[57] ABSTRACT

A method is disclosed for preparing an emulsion having grains rich in silver bromide in the presence of gelatin as a protective colloid in a reaction vessel wherein a yield of more than 250 g of precipitated silver nitrate per liter of reaction vessel mixture is attained, wherein at least 70% of a total projected area of all grains is provided by {111} tabular grains having an average aspect ratio of more than 2:1 and an average thickness of from 0.05 up to 0.30 $\mu$m and wherein a ratio by number of percentage amounts of hexagonal tabular grains to triangular tabular crystals present is more than 10:1, said method comprising following steps:

preparing in a reaction vessel a gelatinous dispersion medium containing an initial amount of oxidized gelatin corresponding with less than 50% of a total amount of gelatin used in the said method, and said dispersion medium having a volume of less than 2 liter per 500 g of silver nitrate to be precipitated;

precipitating therein silver halide crystal nuclei by double-jet precipitation of an aqueous silver nitrate and an aqueous solution comprising halide ions, wherein less than 10% by weight of a total amount of silver nitrate used is consumed;

adding to said reaction vessel gelatin in an amount of more than 50% of a total amount of gelatin used in the said method;

growing said silver halide crystal nuclei by further precipitation of silver halide by means of double-jet precipitation of an aqueous silver nitrate solution and an aqueous solution comprising halide ions, wherein more than 90% by weight of a total amount of silver nitrate is consumed, concentrating by ultrafiltration the said reaction mixture volume in the said reaction vessel obtained during precipitation growth steps.

10 Claims, No Drawings

PREPARATION METHOD OF MORPHOLOGICALLY HOMOGENEOUS (111) TABULAR CRYSTALS RICH IN SILVER BROMIDE

This application claims the benefit of U.S. Provisional Application Ser. No. 60/070,498 filed Jan. 5, 1998.

FIELD OF THE INVENTION

The present invention relates to a method for preparing homogeneously divided substantially hexagonal {111} tabular grains rich in silver bromide.

BACKGROUND OF THE INVENTION

Tabular silver halide grains are grains possessing two parallel crystal faces with a ratio between the diameter of a circle having the same area as these crystal faces, and thickness, being the distance between the two major faces, of two or more.

Tabular grains are known in the photographic art for quite some time. As early as 1961 Berry et al. described the preparation and growth of tabular silver bromoiodide graiins in Photographic Science and Engineering, Vol 5, No 6. A discussion of tabular grains appeared in Duffin, Photographic Emulsion Chemistry, Focal Press, 1966, p. 66–72.

Early patent literature includes Bogg U.S. Pat. No. 4,063,951, Lewis U.S. Pat. No. 4,067,739 and Maternaghan U.S. Pat. Nos. 4,150,994; 4,184,877 and 4,184,878. However the tabular grains described herein cannot be regarded as showing a high diameter to thickness ratio, commonly termed aspect ratio. In a number of U.S. Pat. Nos. filed in 1981 and issued in 1984 tabular grains with high aspect ratio and their advantages in photographic applications are described as e.g. U.S. Pat. Nos. 4,434,226; 4,439,520; 4,425,425 and 4,425,426 and in Research Disclosure, Volume 225, January 1983, Item 22534.

The anisotropic growth of the said tabular grains is known to be due to the formation of parallel twin planes in the nucleation step of the precipitation.

The shape of the tabular grains miy be variable: triangular, hexagonal, disc-shaped, trapezoidal and even needle-shaped grains can be formed. The said shape can be regular or irregular.

The appearance of triangular or hexagonal grains is mainly concerned with the number of twin planes: it has been observed that an uneven number of twin planes leads to a triangular shape of the grains, whereas an even number leads to a hexagonal shape, whereas the appearance of trapezoidal and needle-shaped grains is related with the coalescence phenomena or the formation of non-parallel twin planes. These topics have been discussed in J. Imag. Sci. 31, 1987, p. 15–26 and p. 93–99.

Emulsion preparation of tabular grains by means of the methods well-known by a person skilled in the art of photography leads to grain populations consisting of a mixture of all shapes of crystals described hereinbefore.

As a consequence many attempts have been made in order to improve the degree of homogeneity of the size and shape of the crystals. In this context EP-A's 0 566 076; 0 506 947; 0 518 066 and 0 513 722 and U.S. Pat. No. 4,797,354 are related with the preparation of monodisperse hexagonal tabular crystals. In said U.S. Pat. No. 4,797,354 the preparation has been described of tabular emulsions having a high percentage of hexagonal, tabular crystals, accounting for from 70 to 100% of the total projected area of the said crystals with an average aspect ratio of from 2.5/1 to 20/1. However the examples therein, and in the other references cited, are illustrative for a low yield of silver halide emulsion in the reaction viessel mixture, said yield being defined as amount of silver nitrate precipitated per liter of the said reaction vessel mixture.

For radiographic applications photographic advantages of tabular grains if compared with normal globular grains are a high covering power at high forehardening levels as set forth in U.S. Pat. No. 4,414,304. Further a high developability and high sharpness especially in double side coated spectrally sensitized materials can be obtained. The thinner the tabular grains and the lower the number of non-tabular grains in the total grain population the greater these advantages are. To express it in another way: a high degree of homogeneity in grain morphology is desired, leading to a high covering power in order to further offer the possibility to coat lower amounts of silver. With respect to ecology it is thus of utmost importance to prepare tabular grains rich in silver bromide having an enhanced covering power.

The desire to have morphologically homogeneous tabular crystals however doesn't match with another desired feature: a high degree of homogeneity requires preparation of tabular grains during a long time in diluted reaction vessels, which is undesirable from an economical (waste of time) as well as from an ecological (waste of preparation solutions) point of view. In order to manufacture emulsions in a cost-effective way the yield should be naximized, meaning a minimum end volume of the precipitation mixture for a maximum amount of precipitated silver halide. In U.S. Pat. No. 4,334,012 a suitable way has been disclosed of concentrating the reaction mixture volume in the reaction vessel by applying as well-known emulsion washing technique ultrafiltration in a continuous way during the precipitation steps. These references however do not include teachings with respect to the preparation of monodisperse emulsions.

OBJECTS OF THE INVENTION

Therefore it is a first object of the present invention to provide a method for preparing {111} tabular grains rich in silver bromide having a high degree of morphologic homogeneity. More particularly hexagonal {111} tabular cristals are envisaged in a percentage amount as high as possible versus other grain shapes that are leading to the presence of redundant amounts of silver which do not contribute effectively to the desired photograpic properties. Said desired properties are e.g. low coating amounts of silver nevertheless showing a high covering power after processing.

A further object of the present invention is to prepare the said {111} tabular grains rich in silver bromide accounting for an amount by number of the total amount of grains as high as possible in order to make said tabular grains account for at least 70% of the total projective area of all grains, showing high morphologic homogeneity in concentrated reaction vessels in order to improve the precipitation efficiency and to make the preparation process more economically and ecologically acceptable.

Other objects will become apparent from the description hereinafter.

SUMMARY OF THE INVENTION

In accordance with the present invention a method is provided for preparing an emulsion having grains rich in silver bromide in the presence of gelatin as a protective colloid in a reaction vessel wherein a yield of more than 250 g of precipitated silver nitrate per liter of reaction vessel mixture is attained, wherein at least 70% of a total projected area of all grains is provided by {111} tabular grains having an average aspect ratio of more than 2:1 and an average thickness cf from 0.05 up to 0.30 μm and wherein a ratio by number of hexagonal tabular grains to triangular tabular crystals present is more than 10:1, said method comprising following steps:

preparing in a reaction vessel a gelatinous dispersion medium containing an initial amount of (oxidized) gelatin corresponding with less than 50% of a total amount of gelattin used in the said method, said initial amount of (oxidized) gelatin having an average methionine content of less than 30 μmoles per mole and said dispersion medium having a volume of less than 2 liter per 500 g of silver nitrate to be precipitated;

precipitating therein silver halide crystal nuclei by double-jet precipitation of an aqueous silver nitraite and an aqueous solution comprising halide ions, wherein less than 10% by weight of a total amount of silver nitrate used is consumed;

adding to said reaction vessel gelatina in an amount of more than 50% of a total amount of gelatin used in he said method;

growing said silver halide crystal nuclei by further precipitation of silver halide by means of double-jet precipitation of an aqueous silver nitrate solution and an aqueous solution comprising halide ions, wherein more than 90% by weight of a total amount of silver nitrate is consumed, concentrating by ultrafiltration the said reaction mixture volume in the said reaction vessel obtained during precipitation growth steps.

Concentrating by ultrafiltration the said reaction mixture volume in the reaction vessel during precipitation growth steps is applied at any moment when said ultrafiltration is performed e.g. with an ultrafiltration flux equal to or higher than total flow rates of silver salt and halide salt solutions.

By this method it is possible to prepare a gelatinous silver halide emulsion having {111} tabular silver bromide, silver bromoiodide, silver bromochloride or silver bromochloroiodide grains, wherein at least 70% of the total projected area of all grains is provided by tabular {111} grains having a preferred average aspect ratio of more than 2:1 and an average thickness of from 0.05 to 0.30 μm, wherein a ratio by number of percentage amounts of hexagonal tabular grains to triangular tabular crystals present is more than 10:1.

DETAILED DESCRIPTION OF THE INVENTION

In a reaction vessel a dispersion medium containing gelatin having less than 30 μmoles of methionine per gram is preferably prepared in order to apply the method of the present invention: an increased number of {111} tabular grains rich in silver bromide in the is total grain population is obtained if use is made in the preparation method of the so-called "oxidized gelatn", characterized by the presence in the said gelatin of amounts of methionie of less than 30 μmoles per gram of gelatin as set forth in U.S. Pat. No. 4,713,320 and in Research Disclosure 29945, published March 1989. A Preparation method of {111} tabular grain emulsions wherein in the grain growth process use is made of gelatin derivatives with chemically modified $NH_2$-groups and wherein said gelatin has a specific methionine content has been described in EP-A 0 697 618. Modification of the methionine content of a gelatinous dispersion medium by means of an oxidizer which should be added to the reaction vessel immediately before nucleation formation has been described in U.S. Pat. No. 5,372,975, wherein seed grains are further added. Seed grains formed in the presence of an oxidizing agent have been described in JP-A 05-213187, in JP-A 06-003758 and in JP-A 06-003759. Processing a gelatin solution by means of $H_2O_2$ has been described in JP-A 05-341415. Other oxidizing agents besides hydrogen peroxide as e.g. ozone, peroxy acid salts, halogens, thiosulphonic acid salts, quinones and organic peroxides have been used as disclosed in U.S. Pat. No. 5,489,504. Further in order to provide tabular grains having small twin-plane separations in tabular grains rich in silver bromide a preparation method making use of oxidized gelatin has been described in U.S. Pat. No. 5,219,720.

It should be stressed that it is an essential feature that in the reaction vessel said oxidized gelatin is present in an amount of less than 50% of the total amount of gelatin present in the emulsion at the end of the preparation and that the dispersion medium present. before starting precipitation has a volume of less than 2 liter per 500 g of silver nitrate to be precipitated. This means that the nucleation step proceeds in a concentrated reaction vessel, more concentrated than has hitherto been disclosed.

According to the method of the present invention after preparing in a reaction vessel a dispersion medium containing gelatin having less than 30 μmoles of methionine per gram according to the method of this invention, a total amount of silver nitrate of less than 10% by weight, and more preferably 0.5% to 5.0%, is added during the nucleation step which preferably consists of an approximately equimolecular simultaneous addition of silver nitrate and halide salts at a pBr of 1.0 to 2.0.

The rest of the silver nitrate and halide salts is added during one or more consecutive double jet growth step(s) after having added to said reaction vessel. Gelatin added before and/or during the said growth can be oxidized gelatin, already defined hereinbefore, or non-oxidized gelatin having 30 or more μmoles of methionine per gram so that the total amount of gelatin may contain per gram an average amount of higher than 30 μmoles of methionine, and even up to about 80 μmoles per gram.

In a preferred embodiment according to the method of the present invention, growing said silver halide crystal nuclei proceeds by precipitation of silver halide by means of double-jet precipitation of an aqueous silver nitrate solution and an aqueous solution comprising halide ions, wherein more than 90% and more preferably up to 95% by weight of the total amount of silver nitrate is consumed.

The different steps of the precipitation can be alternated by physical ripening steps or by so called "neutralization steps", during which the pAg value is changed to a value required in the next growth step by adding an amount of silver nitraze solution or a water soluble halide salt within a well-defined time of addition by means of the single-jet technique. Alternative ways to regulate the pAg to the desired value before continuing the processing are diluting the emulsion present in the reaction vessel, diafiltration or ultrafiltration and even flocculation and washing procedures, the last techniques being preferred to concentrate the emulsion crystals in the reaction vessel. Any combination or any choice of the mentioned techniques may be applied thereto.

At least two growth steps are commonly used. The ratio of the second growth step to the first growth step and the per in this second growth step is such that the tabular {111} grains rich in silver bromide at the end of the preparation according to the method of the present invention exhibit an average aspect ratio of at least 2:1, more preferably from 5:1 to 15:1, wherein tabular {111} grains rich in silver bromide account for at least 70%, and more preferably at least 90% of the total projected area of all grains. Further said tabular grains rich in silver bromide, prepared according to the method of the present invention have an average thickness of from 0.05 to 0.30 μm, and more preferably from 0.05 up to 0.20 μm and a coefficient of variation of the grain size distribution of tabular grains of less than 0.30 and more preferably between 0.10 and 0.20. In order to obtain such a high degree of homogeneity useful compounds added to the reaction vessel are polyalkyleneoxides as in U.S. Pat. Nos. 5,252,442 and 5,147,771.

During the growth step(s) an increasing flow rate of silver and halide solutions is preferably applied, e.g. a linearly increasing flow rate. Typically the flow rate at the end is about 3 to 10 times greater then at the start of the growth step. For a succesful preparation of emulsions having tabular grains rich in silver bromide according to the method of the present Lnvention the pBr before the start and during the different stages of the precipitation is maintained at a well-defined value as will become apparent from the examples hereinafter.

In another embodiment of the method of the present invention nuclei can be prepared in a separate vessel, whereas growth of the said nuclei may proceed in another vessel.

According to the present invention, besides performing nuclation in a concentrated reaction vessel, it is of utmost importance to concentrate the reaction mixture volume obtained by ultrafiltration during the precipitation growth steps by applying during said ultrafiltration process an ultrafiltration flux equal to (as preferred in steady-state circumstances) or higher than total flow rates of silver salt and halide salt solutions, thereby concentrating silver halide formed in the said reaction vessel to at least 250 g, expressed as an equivalent amount of silver nitrate, per liter, preferably up to 300 g and even more preferred up to 450 g per liter. In order to get the preferred volume of the reaction mixture in the reaction vessel it is however possible that a temporary lower ultrafiltration flux is required. The practically applied ultrafiltration or membrane flux further is a function of the total operative surface of the membrane and the trans-membrane pressure. The right choice of the membrane used in order to reach the desired volurie of the reaction mixture in the reaction vessel is thus very important. Preferably the ultrafiltration procedure is applied in a continuous way during the precipitation steps, but, if required, it can be interrupted for short periods as e.g. during physical ripening preferably no ultrafiltration is applied. By applying the ultrafiltrattion procedure the total reaction mixture volume can be lowered during the precipitation. Alternatively the reaction mixture volume can be readjusted, e.g. kept constant by the application of an additional jet of water. By the methods described it is possible to redice the end precipitation volume and to concentrate silver halide to values set forth hereinbefore. This achievement cannot be attained by solely concentrating the silver ion and halide ion jets as in that case a tremendous deviation from the required morphologic homogeneity and homogeneity of the crystal size distribution is observed, but as already set forth hereinbefore, by the presence in low amounts of oxidized gelatin in a low starting volume of the reaction vessel. In a preferred embodiment the ultrafiltration module is conceived in such a way that the total volume of the ultrafiltration module and of its connecting means, is lower than ⅓ of the total precipitation volume. Moreover the circulation flux through the ultrafiltration module is preferably high enough, in order to achieve a delay time in the module of any liquid volume unit of lower than 60 seconds and, most preferably lower than 30 seconds. Even drelay times as low as 10 seconds can be achieved.

A preferred ultrafiltration module for the practice of this invention is a ROMICON HF2-20-PM10, provided with a pump. For a typical precipitation (see examples) the flow rate of the silver ion jet during the growth step(s) is linearl-y increased to an end rate of 25 ml/min per 500 g of silver nitrate to be precipitated and a linearly increasing flux having an end rite of about 50 ml/min is applied. But in the case of more strongly increasing flow rates, e.g. quadratically increasing flow rates, a flux of about 200 ml/min can be established if required.

A gelatinous silver halide emulsion is thus prepared according to the method of the present invention, wherein said emulsion has silver bromide, silver bromoiodide, silver bromochloride or silver bromochloroiodide grains (wherein the halide present in the highest amount as expressed in mole % is called first), and wherein at least 70% of the total projected area of all grains is provided by tabular {111} grains having an average aspect ratio of more than 2:1 and an average thickness of from 0.05 to 0.30 μm, wherein a ratio by number of hexagonal tabular grains to triangular tabular grains is more than 10:1, and more preferably more than 20:1. Said silver halide is furthermore, according to the present invention, present in said emulsion in an amount per liter of at least 250 g, more preferred up to 300 g and even up to 450 g, wherein silver halide is expressed as an equivalent amount of silver nitrate.

In order to determine the methionine content of gelatin many references from literature are available as e.g. in J.Phot.Sc., Vol. 28(1980), p.111–118, wherein as most obvious reducing substances in gelatin methionine residues of the macromolecule are determined in reaction with Au(III)-ions. The so-called "gold number" permits determination of amounts of methionine in the gelatin following the rule that 1 mmole of Au corresponds with 1.6 mmole of methionine. In J.Phot.Sc., Vol. 33(1989), p.10–17 the methionine content was determined using the gaschromatographic procedure developed by Apostolatos and Hoff (Anal. Biochem. Vol. 118(1981), p.126) and applied to gelatin by Rose and Kaplan. In this article calorimetry is used in a quantitative procedure for determining methionine (constant over initial pH range examined: 3.0–8.0). In J.Phot.Sc., Vol. 40(1992), p.149–151, amounts of methionire, methionine sulphoxide and methionine sulphone are determined by a chromatographic technique for amino acids (Hitachi Amino Acid Analyser), whereas in J.Phot.Sc., Vol. 41(1993), p.172–175, these compounds are determined by HPLC. In J.Phot.Sc., Vol. 39(1995), p. 367–372, it has been established that a good correlation between methionine content determined by Rose and Kaplan making use of gas chromatographic techniques (4th IAG Conference, Fribourg 1985, Amman-Brass & Pouradier) and the Scatchard technique (described in J.Phot.Sc., Vol. 42(1994), p.117–119) can be found. In the said technique the interaction at pH=3.0 of $Ag^+$ and gelatin is determined by means of potential measurements of free $Ag^+$-ions.

In a preferred embodiment of the presentinvention, gelatin differing from the initial amount of gelatin present in the reaction vessel and which is added after ending nucleation, is added in an amount of more than 80% by weight of the total amount of gelatin used, wherein said gelatin differing from said initial amount of gelatin contains methionine in an amount of more than 30 μmoles per gram. As an advantage thereof the homogeneity of the diameter of the formed crystals is still further improved in that the standard deviation thereof is decreased.

Preferably according to the method of the present invention in said silver silver bromoiodide or silver bromochloroiodide iodide ions are present in an amount of up to 3 mole % and in a preferred embodiment iodide ions are provided by means of an iodide releasing agent. Patent applications referring to methods wherein iodide releasing agents are used are e.g. EP-A's 0 563 701, 0 563 708, 0 561 415 and 0 651 284.

Preparation of silver bromo(chloro)iodide emulsion crystals can be achieved by mixing a soluble bromideo or bromochloride mixture and a soluble iodide salt in one or more of the halide solutions up to the desired concentrations, expressed in mol %, required in each preparation step by double jet or by a triple jet technique by separate addition of an iodide containing aqueous solution. Due to the lower solubility of silver iodide in comparison with silver bromide, said iodide ions are able to displace bromide and chloride ions from the grain, a technique known in the art as conversion. Iodide ions may also be incorporated into the silver halide crystal lattice by the addition of a previously prepared silver iodide micrate emulsion, composed of either pure silver iodide or mixed halide ultrafine crystals, but as has already set forth hereinbefore in a preferred embodiment iodide releasing agents are used, at least partially, e.g. in one or more conversion steps during or at the end of the precipitation. Even bromide releasing agents are not excluded in the precipitation steps according to the method of this invention.

Silver chloride, if present as in silver bromochloride or silver bromochloroiodide emulsions, takes about 5 mole % up to 20 mole % in the composition of the silver halide grains rich in silver bromide.

Two or more types of tabular silver halide emulsions that have been prepared differently can be mixed for forming a photographic emulsion for use in photographic materials according to the present invention, depending on the desired specifications.

The size distribution of the {111} tabular silver halide particles of the photographic emulsions prepared according to the method of the present invention is thus monodisperse as it is not desirable to have a low contrast, especially in the higher densities of the sensitometric curve, characteristic for heterodisperse emulsions with a coefficient of variation of the tabular grains between 0.20–0.40 which show a lower covering power. As set forth in the objects of the present invention a higher covering power is preferred, in order to coat less silver in the emulsion layers of suitable silver halide photographic materials and therefore the more homodisperse emulsions, prepared according to the method of the present invention are preferred with coefficients of variation being lower than 0.20 and more preferred from 0.10 to less than 0.20.

Tabular silver halide emulsions rich in silver bromide, prepared by the method of the present invention, can be chemically sensitized as has been described e.g. in "Chimie et Physique Photographique" by P. Glafkides, in "Photographic Emulsion Chemistry" by G. F. Duffin, in "Making and Coating Photographic Emulsior" by V. L. Zelikman et al, and in "Die Grundlagen der Photographischen Elrozesse mit Silberhalogeniden" edited by H. Frieser and published by Akademische Verlagsgesellschaft (1968). Chemical sensitization has e.g. also been described in Research Disclosure N° 38957 (September 1996), Chapter IV. As described in said literature chemical sensitization can be carried out by effecting the ripening in the presence of small amounts of compounds containing sulphur e.g. thiosulphate, thiocyanate, thioureas, sulphites, mercapto compounds, and rhodamines. Said compounds containing sulphur can also be, at least partially, replaced by compounds containing selenium and/or tellurium. The emulsions may be sensitized also by means of gold-sulphlur, gold-sulphur-selenium, gold-selenium ripeners or by means of reciuctors as e.g. tin compounds described in GB-Patent 789,823, amines, liydrazine derivatives, formamidine-sulphinic acids, and silane compounds.

The tabular silver halide emulsions may be spectrally sensitized with methine dyes such as those described by F. M. Hamer in "The Cyanine Dyes and Related Compounds", 1961, John Wiley & Sons and in Research Disclosure N° 38957 (1994), Chapter V. Dyes that can be used for the purpose of spectral sensitization include cyanine dyes, merocyanine dyes, complex cyanine dyes, complex merocyanine dyes, hemicyanine dyes, styryl dyes and hemioxnol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in the already cited Research Disclosure Item 22534. Oxacarbocyanines have been described e.g. in U.S. Pat. No. 5,434,042. Especially preferred green sensitizers in connection with the present invention are anhydro-5,5'-dichloro-3,3'-bis(n.sulfobutyl)-9-ethyloxacarbo-cyanine hydroxide and anhydro-5,5'-dichloro-3,3'-bis(n.sulfopropyl)-9-ethyl-oxacarbo-cyanine hydroxide. Imidacarbocyanines as e.g. those described in Research Disclosure N° 37312 (1995) may be useful as well as combinations of oxacarbocyanines and imidacarbocyanines as in EP-A 0 590 593 from the viewpoint of sensitivity as well as from the viewpoint of decolouring properties and stain removal in the processing of materials containing spectrally sensitized tabular grains rich in silver bromide as in this invention.

In classical emulsion preparation spectral sensitization traditionally follows the completion of chemical sensitization. However, in connection with tabular grains, it is specifically considered that spectral sensitization my occur simultaneously with or may even precede completely the chemical sensitization step: the chemical sensitization after spectral sensitization is believed to occur at one or more ordered discrete sites of tabular grains. This may also be done with the emulsions prepared according to the present invention, wherein the chemical sensitization proceeds in the presence of one or more phenidone and derivatives, a dihydroxy benzene as hydroquinone, resorcinol, catechol and/or a derivative(s) therefrom, one or more stabilizer(s) or antifoggant(s), one or more spectral sensitizer(s) or combinations of said ingredients. Especially 1-p-carboxyphenyl, 4,4' dimetliyl-pyrazolidine-3-one may be added as a preferred auxiliary agent.

The gelatinous silver halide emulsion rich in silver bromide of the present invention, characterized by a specific gelatin composition as set forth hereinbefore is further coated in hydrophilic layer(s) which may, just as non-light-sensitive layers of the photographic material according to this invention, comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion layer or to other coating layers in water-permeable relationship therewith such as an undercoat or a protective layer. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benotriazoles (preferably 5-methyl-benzotriazole), nitrobenzotria-zoles, mercaptotetrazoles, in particular 1-phenyl-5-mercaptotetrazole, iiercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1352), pages 2–58, triazolopyrimidines such as those described in GB 1,203, 757, GB 1,209,146, JP-A 75/39537, and GB-A 1,500,278, and 7-hydroxy-s-triazolo-[1,5-a]-pyrimidines as described in U.S. Pat. No. 4,727,017, and other compounds such as benzenethiosulfonic acil, benzenethiosulfinic acid and benzenethiosulfonic acid amide. Other compounds that can be used as fog-inhibiting compounds are described in Research Disclosure N° 17643 (1978), Chapter VI and in RD N° 38957 (1996), Chapter VII. Many of these fog-inhibiting compounds may have been already added during the chemical ripening of the tabular silver halide crystals rich in silver bromide.

It is clear that additional gelatin is added in a later stage of the emulsion preparation, e.g. after washing, in order to establish optimal coating conditions and/or to establish the required thickness of the coated emulsion layer. Preferably a gelatin to silver halide ratio ranging from 0.3 to 1.0 is then obtained, wherein extra gelatin added is not required to have a composition as specific as in the preparation step of the grains according to the method of the present invention. Another binder may also be added instead of or in addition to gelatin or gelatin derivatives as e.g. phthalated gelatin. Useful vehicles, vehicle extenders, vehicle-like addenda and vehicle related addenda have been described e.g. in Research Disclosures Nos 36544 (1994) and 38957 (1996), Chapter II.

The gelatin binder of the photographic material having at least one gelatinous emulsion according to the present invention can be forehardened with appropriate hardening agents such as those of the epoxide type, those of the ethylenimine type, those of the vinylsulfone type e.g. 1,3-vinylsulphonyl-2-propanol, chromium salts as e.g. chromium acetate and chromium alum, aldehydes e.g. formaldehyde, glyoxal, and glutaraldehyde, N-methylol compounds e.g. dimethylol-urea and methyloldimethylhydantoin, dioxan derivatives e.g. 2,3-dihydroxydioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salt-s as disclosed in U.S. Pat. No. 4,063,952 and with the onium compounds as disclosed in EP-A 0 408 143.

In a preferred embodiment the hydrorhilic layer package of silver halide photographic materials comprising in one or more light-sensitive layers one or more {111} tabular emulsions rich in silver bromide crystals prepared according to the method of the present invention, has a swelling degree of not mere than 200%. Said swelling degree is determined by means of the following procedure: a sample of the coated material is incubated at 57° C. and 34% RH for 3 days, whereafter the thickness (a) of the layer assemblage is measured. Thereafter the sample is immersed in distilled water at 21° C. for 3 minutes and the thickness (b) of the swollen layer is measured. The swelling ratio is then calculated as: (b—a)/a×100 (%).

The gelatinous emulsions comprising tabular grains rich in silver bromide of the present invention can be used in various types of photographic elements, e.g. black and white silver halide photographic materials, like materials used for X-ray diagnostic purposes, or colour sensitive materials.

In a preferred embodiment according to the present invention said photographic element or material comprises a support and on one or on each side thereof one or more silver halide emulsion layer(s) coated from a gelatinous emulsion according to the present invention. More specifically said photographic material is a single-side or double-side coated X-ray material.

The single-side coated X-ray material may contain one single emulsion layer, as it is the case for many applications, or it can be built up by two or even more emulsion layers. In X-ray photography a material with a single or a duplitized emulsion layer coated on one or both sides of the support thus contains at least one gelatinous silver halide emulsion according to the present invention. By using duplitized emulsions differing in photographic speed by at least 0.15 log E a gain in cross-over exposure in double side coated materials can be obtained. In the case of colour photography the material contains blue, green and red sensitive layers each of which can be single coated, but merely consists of double or even triple layers. Besides the light sensitive emulsion layer(s) the photographic material may contain several light-insensitive layers, e.g. a protective layer, one or more backing layers, one or more subbing layers, one or more intermediate layers e.g. filter layers and even an afterlayer containing e.g. the hardening agent(s), the antistatic agent(s), filter dyes for safety-light purposes, etc.

The photographic element of the present invention may further comprise various kinds of coating physical property modifying addenda as described in RD's Nos 36544 (1994) and 38957 (1996), Chapter IX, wherein coating aids, plasticizers and lubricants, antistats and matting agents have been described. Development acceleration can be accomplished by incorporating in the emulsion layer or adjacent layers various compounds, preferably polyalkylene derivatives having a molecular weight of at least 400 such as those described in e.g. U.S. Pat. Nos. 3,038,805; 4,038,075 and 4,292,400 as well as in EP-A's 0 634 688 and 0 674 215.

The photographic element of the present invention may further comprise various other additives such as e.g. compounds improving the dimensional stability of the photographic element, UV-absorbers, spacing agents and plasticizers.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in RD's Nos. 36544 (1994) and 38957 (1996), Chapter VI, wherein also suitable optical brighteners are mentioned. UV-absorbers are especially useful in colour materials where they prevent the fading by light of the colour images formed after processing.

Spacing agents can be present of which, in general, the average particle size is comprised between 0.2 and 10 $\mu$m. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonit:riles, olefins, and styrenes, or copolymers of the above with acrylic acids, methacrylic acids, $\alpha,\beta$-unsaturated dicarboxylic acids hydroxyalkyl (meth)acrylates, sulphoalkyl (meth)acrylales, and styrene sulphonic acids.

The photographic material may contain several non-light sensitive layers, e.g. an antistress topcoat layer, one or more backing layers, and one or more intermediate layers eventually containing filter dyes or antihalation dyeas that absorb scattering light and thus promote the image sharpnes. Suitable light-absorbing dyes used in these intermediate layers arms described in e.g. U.S. Pat. Nos. 4,092,168 and 4,311,787, in DE-A 2,453,217, and in GB-A 7,907,440. Situated in such an intermediate layer between the emulsion layers and the support there will be only a small negligible loss in sensitivity but in rapid processing conditions discoloration of the filter dye layers may form a problem. Therefor it should be recommended to decrease the thickness of the whole coated layer packet resulting in shorter drying times after washing in the processing cycle. Alternatively the use of intermediate layers situated between emulsion layer(s) and support, reflecting the fluorescent light emitted by the screens may bring a solution. As the light emitted from the screens by the phosphors incorporated therein is a very important source of light-scattering the addition of appropriate filter dyes to the screens may be recommended. In the presence in the screens of e.g. green light-emitting phosphors use may be made of specific dyes as MAKROLEX ORANGE G or GG, trademarked products of BAYER AG.

One or more backing layers can be provided at the non-light sensitive side of the support of materials coated with at least one emulsion layer at only one side of the support. These layers which can serve as anti-curl layer can contain e.g. matting agents like silica particles, lubricants, antistatic agents, light absorbing dyes, opacifying agents, e.g. titanium oxide ani the usual ingredients like hardeners and wetting agents.

The support of the photographic material may be opaque or transparent, e.g. a paper support or resin support. When a paper support is used preference is given to one coated at one or both sides with an $\alpha$-olefin polymer, e.g. a polyethylene layer which optionally contains an anti-halation dye or pigment. It is also possible to use an organic resin support e.g. cellulose nitrate film, cellulose acetate film, poly(vinyl acetal) film, polystyrene film, poly(ethylene. terephthalate) or poly(ethylene naphthalaze) film, polycarbonate film, polyvinylchloride film or poly-$\alpha$-olefin films such as polyethylene or polypropylene film. The thickness of such organic resin film is preferably comprised between 0.07 and 0.35 mm. These organic resin supports are preferably coated with a suboing layer which can contain water insoluble particles such as silica or titanium dioxide.

The photographic material containing tabular grains prepared according to the present invention can be image-wise exposed by any convenient radiation source in accordance with its specific application.

Of course processing conditions and composition of processing solutions are dependent from the specific type of photographic material in which the tabular grains prepared according to the present invention are applied. For example, in a preferred embodiment of materials for X-ray diagnostic purposes sexid materials may be adapted to rapid processing conditions. Preferably an automatically operating processing apparatus is used provided with a system for automatic regeneration (replenishment) of the processing solutions.

The forehardened material may be processed using one-part package chemistry or three-part package chemistry, depending on the processing application determining the degree of hardening required in said processing cycle. Applications within total processing times of 30 seconds and lower up to 90 seconds, known as common praxis, are possible. From an ecological point of view it is e.g. possible to use sodium thiosulphate instead of ammonium thiosulphate.

By the method of this invention it is thus possible to provide a high covering power for different hardening levels of the layer material, wherein the substantially hexagonal {111} tabular grains rich in silver bromide are coated in gelatinous emulsion form, accounting for at least 70% of the total projective area of all grains.

While the present invention will hereinafter in the examples be described in connection with a preferred embodiment thereof, it will be understood that it is not intended to limit the invention to that embodiment. On the contrary, it is interded to cover all alternatives, modifications and equivalents as may be included in the spirit and scope of the invention as defined by the claims.

EXAMPLES

All tabular grains were precipitated using the double jet technique with control of the pAg value, said value being defined as the negative logarithm of the silver ion concentration.

After precipitation, every example was analyzed using shadowed carbon replicas obtained with an electron microscope. For each example a minimum of hundred grains were measured and the following characteristics were then calculated:

- the number of tabular grains were calculated, a tabular grain being defined as a grain with two parallel main planes and a ratio between the diameter and the thickness of the grains of at least 2, with
- the diameter being the diameter of a circle having an equivalent projective surface area as the grain and
- the thickness being the distance between the main planes of the flat tabular crystals.

A characterization of the crystal population of an emulsion was given by:

- average diameter size $d_{Tab}$: calculated as the average (by number) from the diameters of the tabular grains;
- average standard deviation of the average diameter size $s_{dTab}$;
- average thickness $t_{Tab.}$: calculated as the average (by number) from the distance between the main planes measured for all crystals
- percentage amount of hexagonal tabular crystals present in the total population of tabular crystals: $T_{hex.}$, expressed as percentage of the total silver coverage (=volume);

percentage amount of triangular tabular crystals present in the total population of tabular crystals: $T_{triang.}$, expressed as percentage of the total silver coverage (=volume).

Example 1

Comparative Examples

As comparative Examples the Emulsions Nos. 1–4 were prepared according to the Examples described in EP-A 0 577 886.

Comparative Emulsion No. 1 EP-A 0 577 886

The following solutions were prepared:

a dispersion medium (C) consisting of 750 ml demineralized water, 4.04 g of inert gelatin and 12.7 ml of a 2.94 molar potassium bromide solution; the temperature was established it 45° C. and pH was adjusted to 4.5; the pAg corresponded to an electrochemical potential of −63 mV measured with a silver electrode versus standard calomel;

1000 ml of a 2.94 molar silver nitrate solution (A);

a mixture of a solution of 2.94 molar potassium bromide and 2.94 molar potassium iodide at a ratio of 99/1 (B).

A nucleation step was performed by introducing solution A and solution B simultaneously in dispersion medium C both at a flow rate of 25 ml/min during 28 seconds. After a physical ripening time of 15 minutes during which the temperature was risen to 70° C. 13.02 g of phtalated gelatin, dissolved in 250 ml of water, was added and the mixture was stirred for an additional 5 minutes. Then a first growth step was performed by introducing simultaneously during 564 seconds solution (A) at a flow rate of 5 ml/min and solution B in such a way that a constant silver potential of −33 mV is maintained. Then a second growth step was performed by introducing by a double jet during 3763 seconds solution A starting at a flow rate of 5 ml/min and linearly increasing the flow rate to an end value of 25 ml/min, and solution B at an increasing flow rate in order to maintain a constant silver potential value of −33 mV.

Ultrafiltration was applied during the growth steps. The circulation rate of the kettle mixture through the ultrafiltration module was 2 liter/min. The dead volume was 250 ml. In this way a precipitation efficiency of approximately 500 g of $AgNO_3$/liter was achieved.

Comparative Emulsion No. 2

The precipitation scheme was identical to emulsion No. 1 with the exception that during the two growth steps the silver potential was maintained at −3 mV instead of −33 mV. The end volume was likewise about 1 l.

Comparative Emulsion No. 3

The following solutions were prepared:

a dispersion medium (C) consisting of 750 ml of demineralized water, 4.04 g of inert gelatin and 12.7 ml of a 2.94 molar potassium bromide solution; the temperature was established at 45° C. and pH was adjusted to 4.5; the pAg corresponded to an electrochemical potential of −63 mV measured with a silver electrode versus standard calomel;

1000 ml of a 2.94 molar silver nitrate solution (A);

a mixture of a solution of 2.94 molar potassium bromide and 2.94 molar potassium iodide at a ratio of 99/1 (B).

A nucleation step was performed by introducing solution A and solution B simultaneously in dispersion medium C both at a flow rate of 25 ml/min during 28 seconds. After a physical ripening time of 15 minutes during which the temperature was risen to 70° C., 13.02 g of phtalated gelatin, dissolved in 250 ml of water, was added and the mixture was stirred for an additional 5 minutes. Then a first growth step was performed by introducing simultaneously during 425 seconds solution A starting at a flow rate of 5 ml/min and linearly increasing the flow rate to an end value of 25 ml/min, and solution B at an increasing flow rate as to maintain a constant silver potential value of −33 mV. A second growth step was performed by introducing simultaneously during 440 seconds solution A starting at a flow rate of 25 ml/min and linearly increasing the flow rate to an end value of 56 ml/min, and solution B at an increasing flow rate in order to maintain a constant silver potential value of −33 mV. A third growth step was performed by introducing simultaneously during 445 seconds solution A starting at a flow rate of 56 ml/min and linearly increasing the flow rate to an end value of 100 ml/min, and solution B at an increasing flow rate as to maintain a constant silver potential value of −33 mV.

By applying continuous ultrafiltration during precipitation the end volume of the reaction mixture was reduced to about 1 l.

Comparative Emulsion No. 4

The precipitation scheme was identical to that of emulsion No. 3 with the exception that during the three growth steps the silver potential was maintained at −3 mV instead of −33 mV. The end volume was likewise about 1 liter.

Inventive Emulsions Prepared According to the Method of the Present Invention:

Inventive Emulsion No. 1

The following solutions were prepared:

a dispersion medium (C) consisting of 900 ml of demineralized water, 2.5 g of oxidized gelatine and 4.26 ml of a 6 N sulfuric acid solution; the temperature was established at 51° C.; the pAg corresponded to a value of 8.77 (UAg=38 mV vs. a Ag/AgCl reference electrode)

a 2.40 molar solution of silver nitrate solution (A);

a 2.40 molar solution of potassium bromide (B1);

a mixture of a solution of 2.36 molar potassium bromide and 0.037 molar potassium iodide (B2);

a solution of 460 ml of demineralized water and 20 g of phthalated gelatin (G).

A nucleation step was performed by introducing solution A and solution B simultaneously in dispersion medium C both at a flow rate of 16 ml/min during 46 seconds. After a physical ripening time of 29 minutes during which the temperature was risen to 70° C., pH was adjusted to a value of 5.8 and 3 minutes later solution G was added and the mixture was stirred for an additional 6 minutes.

A neutralization step was introduced by adding solution (B1) at an addition rate of 3.75 ml/min. during 80 seconds, followed by a first growth step by introducing simultaneously during 200 seconds solution (A) at a flow rate of 3.75 ml/min and solution (B1) in such a way that a constant pAg value of 8.58 (silver potential of 18 mV vs. a silver/silver chloride reference electrode) was maintained. Then a second growth step was performed by introducing by a double jet during 2588 seconds solution A starting at a flow rate of 3.75 ml/min and linearly increasing the flow rate to an end value of 15 ml/min, and solution (B1) at an increasing flow rate in order to maintain a constant pAg of 8.58 (silver potential of 18 mV).

Then a second growth step was performed by introducing by a double jet during 2391 seconds solution A starting at a flow rate of 15 ml/min and linearly increasing the flow rate to an end value of 25 ml/min, and solution (B1) at an increasing flow rate in order to maintain a constant pAg of 8.58 (silver potential of 18 mV).

Ultrafiltration was applied during the precipitation growth steps.

The circulation rate of the vessel mixture through the ultrafiltration module was 2 liter/min. The dead volume was 250 ml. In this way a precipitation efficiency of 360 g $AgNO_3$/liter is achieved.

Inventive Emulsion No. 2

The precipitation scheme was identical to that of emulsion 1 except for the presence in of solution (G) of 42.5 g instead of 20 g of phthalated gelatine.

Inventive Emulsion No. 3

The precipitation scheme was identical to that of emulsion 1 except for the presence in solution (G) of 20 g of an inert low viscous gelatin instead of 20 g of phthalaed gelatine.

Inventive Emulsion No. 4

The precipitation scheme was identical to that of emulsion 1 except for the presence in solution (G) of 42.5 g of an inert low viscous gelatine instead of 20 g of phthalated gelatine.

TABLE 1

| Emulsion No. | $d_{Vol.}$ ($\mu$m) | $d_{Tab.}$ ($\mu$m) | $t_{Tab.}$ ($\mu$m) | % $T_{hex}$ | % $T_{triang}$ | $T_{hex}/T_{triang.}$ |
|---|---|---|---|---|---|---|
| Comp.-1 | 0.59 | 0.36 | 0.19 | 63 | 37 | 1.8 |
| Comp.-2 | 0.60 | 1.25 | 0.19 | 69 | 31 | 2.2 |
| Comp.-3 | 0.59 | 1.36 | 0.23 | 72 | 28 | 2.6 |
| Comp.-4 | 0.33 | 0.75 | 0.23 | 68 | 32 | 2.1 |
| Inv.-1 | 0.53 | 0.99 | 0.18 | 93 | 7 | 13.3 |
| Inv.-2 | 0.56 | 1.01 | 0.18 | 95 | 5 | 19.0 |
| Inv.-3 | 0.54 | 0.93 | 0.21 | 96 | 4 | 24.0 |
| Inv.-4 | 0.55 | 0.85 | 0.21 | 96 | 4 | 24.0 |

As is clear from the data in Table 1 the emulsions prepared according to the present invention are containing a ratio by number of of hexagonal tabular grains to triangular tabular crystals of more than 10:1 and even of more than 20:1, opposite to the comparative emulsions as disclosed in EP-A 0 577 886. It can thus be concluded that the {111} tabular grains rich in silver bromide prepared according to the method of the present invention are substantially hexagonal grains.

The emulsions were further redispersed and chemically ripened to an optimal fog-sensitivity relationship after addition of compounds providing sulfur and gold as chemical sensitizers. Anhydro-5,5'-dichloro-3,3'-bis-(n.sulfobutyl)-9-ethyloxac,irbocyanine hydroxide was added as a green sensitizer.

Each emulsion was stabilized with 4-hydroxy-6-methyl-1,3,3a,7-tetra-azaindene and after addition of the normal coating additives the solutions were coated simultaneously together with a protective layer containing 1.1 g of gelatin per $m^2$ and per side on both sides of a polyethylene terephthalate film support having a thickness of 175 $\mu$m.

Hardening of the layers was performed with formaldehyde.

The resulting photographic material was containing per side of the support an amount of silver halide corresponding to 3.90 grams of $AgNO_3$ per $m^2$.

Exposure,sensitometric and densitometric data:

samples of these coatings were exposed with green light of 540 nm during 0.1 second using a continuous wedge and were processed during the 90 seconds cycle described below. The density as a function of the light dose was measured and therefrom were determined the following parameters:

fog level F (with an accuracy of 0.001 density), sensitivity (speed) S at a density of 1 above fog (in log(Exposure):

a decrease with a factor of 0.30 is indicative for an increase of sensitivity with a factor of 2), the contrast C, calculated between densities 1.0 and 2.5 above fog.

Development processing occurred in a glutaraldehyde containing hydroquinone/1-phenyl-3-pyrazolidinone developer marketed by Agfa-Gevaert N.V. under the trade name G138.

Fixation was carried out in fixer G334, also marketed by Agfa-Gevaert N.V.

Processing conditions and developers used are given hereinafter.

processing machine:CURIX 402 (Agfa-Gevaart trade name) with the following time (in seconds (sec.)) and temperature (in ° C.) characteristics for a total processing time of 98.0 sec:

loading: 3.4 sec.

developing: 23.4 sec./35° C. high or low activity developer cross-over: 3.8 sec.

fixing: 15.7 sec./35° C. in fixer AGFA G334 (trade name)

cross-over: 3.8 sec.

rinsing: 15.7 sec./20° C.

drying: 32.2 sec. (cross-over time included)

Table 2 hereinafter summarizes as sensitometric characteristics for the comparative material (MC-1) and for the inventive materials (MI-1 to MI-4) the fog F, sensitivity (speed) S and contrast (gradation) C of the samples after processing and the covering power (CP) calculated from the ratio of maximum density and grams of coated silver before processing.

TABLE 2

| Material | F | S | C | CP |
|---|---|---|---|---|
| MC-1 | 0.20 | 1.52 | 2.99 | 50 |
| MI-1 | 0.20 | 1.74 | 3.42 | 61 |
| MI-2 | 0.20 | 1.74 | 3.61 | 60 |
| MI-3 | 0.20 | 1.77 | 3.32 | 59 |
| MI-4 | 0.20 | 1.75 | 3.63 | 58 |

It can be concluded that gradation and covering power are remarkably increased for the emulsions prepared according to the method of the present invention.

Example 2

Inventive Emulsion No. 5

In order to prepare the inventive Emulsion No. 5 following solutions were prepared:

a dispersion medium (C) consisting of 900 ml of demineralized water, 2.50 g of oxidized gelatin having a methionine content of 13 $\mu$mole per mole of gelatin and 4.26 ml of a 6 molar solution of sulfuric acid; the temperature was established at 51° C. and a pAg value of 8.77 was measured, corresponding with an electrochemical potential of 38 mV, measured with a silver electrode versus a silver/silver chloride reference electrode;

1000 ml of a 2.40 molar of silver nitrate solution (A);

a solution of 2.40 molar of potassium bromide (B1);

a mixture of a solution of 2.36 molar of potassium bromide and 0.037 molar of potassium iodide (B2).

A nucleation step was performed by introducing solution A and solution B1 simultaneously in dispersion medium C both at a flow rate of 16 ml/min during 46 seconds. After a physical ripening time of 25 minutes during which the temperature was risen to 70° C., 42.5 g of gelatin having a methionine content of 13 μmole/mole of gelatin, dissolved in 460 ml of water, was added and the mixture was stirred for an additional 6 minutes. After a neutralization step by addition of solution B1 at a rate of 3.75 ml/min. during 80 seconds a first growth step was performed by introducing simultaneously during 200 seconds solution (A) at a flow rate of 3.75 ml/min and solution B in such a way that a constant pAg of 8.58 (silver potential of 18 mV) is maintained. Then growth was further performed by introducing by a double jet during 2588 seconds solution A starting at a flow rate of 3.75 ml/min and linearly increasing the flow rate to an end value of 15 ml/muin. Solution B1 was added at an increasing flow rate in order to maintain a constant pAg value of 8.58.

A second growth step was performed after a physical ripening time of 5 minutes by introducing by a double-jet during 2391 seconds solution A starting at a flow rate of 15 ml/min and linearly increasing the flow rate to an end value of 25 ml/min. Solution B1 was added at an increasing flow rate in order to maintain the same constant pAg value of 8.58. An average methionine content of 13 μmole/mole of gelatin was measured.

Ultrafiltration was applied during the growth steps. The reaction mixture volume was maintained at a constant level of 1.39 liter. The circulation rate of the kettle mixture through the ultrafiltration module was 2 liter/min. The dead volume was 250 ml. In this way a precipitation efficiency of approximately 360 g $AgNO_3$/liter is achieved.

Inventive Emulsion No. 5'

The same preparation procedure was followed with the same solutions, except for the presence of methionine in the aqueous gelatinous solution added after the nucleation step in an amount of 50 μmole/mole of gelatin. An average methionine content of 48 μmole/mole of gelatin was measured at the end of the emulsion preparation.

TABLE 3

| Emulsion No. | $d_{VoL}$ (μm) | $d_{Tab.}$ (μm) | $s_{dTab.}$ | $t_{Tab}$ (μm) | % $T_{hex}$ | % $T_{triang}$ | $T_{hex}/T_{triang}$ |
|---|---|---|---|---|---|---|---|
| Comp.-5 | 0.51 | 0.91 | 0.30 | 0.21 | 96 | 4 | 24.0 |
| Inv.-5 | 0.50 | 0.90 | 0.22 | 0.20 | 97 | 3 | 24.0 |

As is clear from the data in Table 3 representing grain characteristics as in Table 1 hereinbefore the inventive emulsion No. 5' not only shows the same degree of morphologic homogeneity with respect to inventive emulsion No. 5, but moreover shows a significantly higher degree of homogeneity on the diameter ($s_{dTab}$. defined hereinbefore as standard deviation on average crystal diameter).

This effect is specifically related with the methionine content of the gelatin added after nucleation.

Example 3

Comparative Emulsions Nos. 5 and 6.

In order to prepare the comparative Emulsion No. 5 following solutions were prepared

- a dispersion medium (C) consisting of 3000 ml of demineralized water, 10 g of oxidized gelatin having a methionine content of 11 μmole per mole of gelatin and 14.2 ml of a 6 molar solution of sulfuric acid; the temperature was established at 51° C. and a pAg value of 8.77 was measured, corresponding with an electrochemical potential of 38 mV, measured with a silver electrode versus a silver/silver chloride reference electrode;
- 1000 ml of a 2.40 molar of silver nitrate solution (A);
- a solution of 2.40 molar of potassium bromide (B1);
- a mixture of a solution of 2.36 molar of potassium bromide and 0.037 molar of potassium iodide (B2).

A nucleation step was performed by introducing solution A and solution B1 simultaneously in dispersion medium C both at a flow rate of 16 ml/min during 46 seconds. After a physical ripening time of 2 minutes the temperature was risen to 70° C. in a time interval of 25 minutes. 2 minutes later the pH value was adjusted to a value of 5.8. 4 g of gelatin having a methionine content of 50 μmole/mole of gelatin, dissolved in 460 ml of water, was added and the mixture was stirred for an additional 6 minutes.

After a neutralization step by addition of solution B1 at a rate of 5.2 ml/min. during 90 seconds a first growth step was performed by introducing simultaneously during 180 seconds solution (A) at a flow rate of 5.2 ml/min and solution B in such a way that a constant pAg of 8.58 (silver potential of 18 mV) was maintained. Then growth was further performed by introducing by a double jet during 3189 seconds solution A starting at a flow rate of 5.2 ml/min and linearly increasing the flow rate to an end value of 9.9 ml/min. Solution B1 was added at an increasing flow rate in order to maintain a constant pAg value of 8.58.

A second growth step was performed after a physical ripening time of 5 minutes by introducing by a double jet during 2391 seconds solution A starting at a flow rate of 9.9 ml/min and linearly increasing the flow rate to an end value of 15.4 ml/min. Solution B1 was added at an increasing flow rate in order to maintain the same constant pAg value of 8.58. An average methionine content of 22 μmole/mole of gelatin was measured. The percentage amount of gelatin in the nucleation step was 71%. As no ultrafiltration step was performed during precipitation the maximum amount of silver halide, expressed as an equivalent amount of silver nitrate, was 83 g/l at the end of the precipitation.

In order to prepare the comparative Emulsion No. 6 ultrafiltration was performed during growth keeping a constant volume of 1390 ml in the reaction vessel. An average methionine content of 22 μmole/mole of gelatin was measured and the percentage amount of gelatin in the nucleation step was 71%. The only difference with comparative emulsion No. 6 was the maximum amount of silver halide, expressed as an equivalent amount of silver nitrate, which was 145 g/l instead of 83 g/l for comparative emulsion No. 5, at the end of the precipitation.

Ultrafiltration thus brings about a higher yield of silver nitrate in the reaction vessel, but not the yield of more than 250 g/liter as required, according to the present invention.

Comparative Emulsion No. 7.

As a starting point a dispersion medium (C) was prepared consisting of 900 ml of demineralized water, 10 g of oxidized gelatin having a methionine content of 11 μmole per mole of gelatin and 4.26 ml of a 6 molar solution of sulfuric acid; the temperature was established at 51° C. and a pAg value of 8.77 was measured, corresponding with an electrochemical potential of 18 mV, measured with a silver electrode versus a silver/silver chloride reference electrode.

This comparative emulsion No. 7 was further prepared in the same way as emulsion No. 6, except for the differences in amounts of demineralized water in the starting vessel as indicated above.

An average methionine content of 22 μmole/mole of gelatin was measured at the end of the preparation of the silver bromoiodide emulsion crystals and the percentage amount of gelatin in the nucleation step was 71%. At the end of the precipitation the only difference with comparative emulsion No. 6 was the maximum amount of silver halide, expressed as an equivalent amount of silver nitrate, which was 360 g/l instead of 145 g/l for comparative emulsion No. 6, thanks to the lower starting volume in the reaction vessel.

Inventive Emulsion No. 6

The same preparation procedure was followed as for the comparative emulsion No. 6, except for the composition of the dispersion medium (C), which was prepared with 900 ml of demineralized water, 2.5 g of oxidized gelatin having a methionine content of 11 μmole per mole of gelatin and 4.26 ml of a 6 molar solution of sulfuric acid; the temperature was established at 51° C. and a pAg value of 8.77 was measured, corresponding with an electrochemical potential of 18 mV, measured with a silver electrode versus a silver/silver chloride reference electrode.

Moreover after the nucleation step, when after a physical ripening time of 2 minutes the temperature was risen to 70° C. in a time interval of 25 minutes and 2 minutes later the pH value was adjusted to a value of 5.8, 11.5 g of gelatin instead of 4 g of gelatin having a methionine content of 50 μmole/mole of gelatin, dissolved in 460 ml of water, was added whereafter the mixture was stirred for an additional 6 minutes.

An average methionine content of 43 μmole/mole of gelatin was measured at the end of the preparation of the silver bromoiodide emulsion crystals and the percentage amount of gelatin in the nucleation step was 18% instead of 71% as for the comparative examples hereinbefore. Just as for the comparative emulsion No. 7 the maximum amount of silver halide, expresses as an equivalent amount of silver nitrate, which was 360 g/l at the end of the precipitation, thanks to the low starting volume in the reaction vessel and to online ultrafiltration which was also applied during the two growth steps.

In Table 4 data have been summarized about average amounts of methionine, about percentage amounts of gelatin in the nucleation step of the emulsion crystal preparation and about maximum amounts of silver nitrate per liter present at the end of the precipitation as volume of the vessel. Moreover volume percentages (vol. %) of hexagonal {111} tabular grains (hex.tabs) have been given as well as $d_{Vol.}$, the average diameter of all crystals calculated from the volume of all spheres, having the same volume as the crystals.

TABLE 4

| Emulsion No. | av. amt. of methionine (μmol/mole) | % amt of gel in nucl. step | max. amt. of $AgNO_3$/l | vol % (hex. tabs) | $d_{Vol.}$ (μm) |
|---|---|---|---|---|---|
| Comp.-5 | 22 | 71 | 83 | . . . 95 | 0.69 |
| Comp.-6 | 22 | 71 | 145 | . . . 90 | 0.67 |
| Comp.-7 | 22 | 71 | 360 | —* | —* |
| Inv.-6 | 43 | 18 | 360 | 93 | 0.72 |

*impossible to determine

As can be concluded from the data in the Table 4, high amounts of {111} tabular hexagonal grains are obtained in a reaction vessel concentrated from the start of the precipitation (in the nucleation step wherein oxidized gelatin is present in low amounts (less than 50% versus the total amount used during grow h precipitation)), wherein ultrafiltration on-line is applied during -he precipitation growth steps As becomes clear from the comparative Examples 5–7 if compared with the inventive Example 6 in the Table 1 hereinbefore, application of ultrafiltration-on-line as such during precipitation in order to concentrate the reaction vessel mixture is an insufficient measure in order to fully reach the objects of the present invention, in particular, to get monodisperse substantially hexagonal {111} tabular grains: more than 250 g of silver nitrate per liter to be precipitated is required, apart from amounts of oxidized gelatin in the nucleation step versus amounts present during growth.

Having described in detail preferred embodiments of the current invention, it will now be apparent to those skilled in the art that numerous modifications can be made therein without departing from the scope of the invention as defined in the following claims.

What is claimed is:

1. Method for preparing an emulsion having grains rich in silver bromide in the presence of gelatin as a protective colloid in a reaction vessel wherein a yield of more than 250 g, expressed as amount of silver nitrate, equivalent with the amount of precipitated silver halide per liter of reaction vessel mixture is attained, wherein at least 70% of a total projected area of all grains is provided by {111} tabular grains having an average aspect ratio of more than 2:1 and an average thickness of from 0.05 up to 0.30 μm and wherein a ratio by number of hexagonal tabular grains to triangular tabular crystals present is more than 10:1, said method comprising following steps:

preparing in a reaction vessel a gelatinous dispersion medium containing an initial amount of gelatin corresponding with less than 50% of a total amount of gelatin used in the said method, said initial amount of gelatin having an average methionine content of less than 30 μmoles per mole and said dispersion medium having a volume of less than 2 liter per 500 g, expressed as amount of silver nitrate, equivalent with the amount of precipitated silver halide;

precipitating therein silver halide crystal nuclei by double-jet precipitation of an aqueous silver nitrate and an aqueous solution comprising halide ions, wherein less than 10% by weight of a total amount of silver nitrate used is consumed;

adding to said reaction vessel gelatin in an amount of more than 50% of a total amount of gelatin used in the said method;

growing said silver halide crystal nuclei by further precipitation of silver halide by means of double-jet precipitation of an aqueous silver nitrate solution and an aqueous solution comprising halide ions, wherein more than 90% by weight of a total amount of silver nitrate is consumed; and concentrating by ultrafiltration the said reaction mixture volume in the said reaction vessel obtained during precipitation growth steps.

2. Method according to claim 1, wherein said tabular {111} grains rich in silver bromide are composed of silver bromide, silver bromoiodide, silver bromochloride or silver bromochloroiodide.

3. Method according to claim 2, wherein in said silver bromoiodide or silver bromochloroiodide iodide is present in an amount of up to 3 mole %.

4. Method according to claim 2, wherein iodide is provided by means of an iodide releasing agent.

5. Method according to claim 1, wherein an average thickness of the said tabular {111} grains is from 0.05 up to 0.20 μm.

6. Method according to claim 1, wherein adding to said reaction vessel gelatin differing from the said initial amount of gelatin is in an amount of more than 80% by weight of total amount of gelatin used, wherein said gelatin differing from said initial amount of gelatin contains methionine in an amount of more than 30 $\mu$moles per gram.

7. Gelatinous emulsion prepared according to the method of claim 1, wherein said emulsion has silver bromide, silver bromoiodide, silver bromochloride or silver bromochloroiodide grains and wherein at least 70% of the total projected area of all grains is provided by tabular {111} grains having an average aspect ratio of more than 2:1 and an average thickness of from 0.05 to 0.30 $\mu$m and wherein a ratio by number of hexagonal tabular grains to triangular tabular grains is more than 10:1.

8. Gelatinous emulsion according to claim 7, wherein a ratio by number of hexagonal tabular grains to triangular tabular grains is more than 20:1.

9. Photographic material comprising a support and on one or on both sides thereof one or more light-sensitive silver halide emulsion layer(s) coated from a gelatinous emulsion according to claim 7.

10. Photographic material according to claim 9, wherein said photographic material is a single-side or double-side coated radiographic material.

* * * * *